US009956777B2

(12) United States Patent
Wang et al.

(10) Patent No.: US 9,956,777 B2
(45) Date of Patent: May 1, 2018

(54) ORIFICE SURFACE, PRINT HEAD COMPRISING AN ORIFICE SURFACE AND METHOD FOR FORMING THE ORIFICE SURFACE

(71) Applicant: Océ-Technologies B.V., Venlo (NL)

(72) Inventors: Zhanhua Wang, Venlo (NL); Han Zuilhof, Venlo (NL); Marc Van Den Berg, Venlo (NL)

(73) Assignee: OCÉ- TECHNOLOGIES B.V., Venlo (NL)

( * ) Notice: Subject to any disclaimer, the term of this patent is extended or adjusted under 35 U.S.C. 154(b) by 3 days.

(21) Appl. No.: 15/178,341

(22) Filed: Jun. 9, 2016

(65) Prior Publication Data

US 2016/0361921 A1 Dec. 15, 2016

(30) Foreign Application Priority Data

Jun. 10, 2015 (EP) ..... 15171464

(51) Int. Cl.
*B41J 2/16* (2006.01)
*B41J 2/14* (2006.01)
*B41J 2/165* (2006.01)

(52) U.S. Cl.
CPC ..... *B41J 2/1433* (2013.01); *B41J 2/162* (2013.01); *B41J 2/1606* (2013.01); *B41J 2/1623* (2013.01); *B41J 2002/16502* (2013.01); *B41J 2202/03* (2013.01)

(58) Field of Classification Search
CPC ..... B41J 2/1433; B41J 2/1606; B41J 2/1623; B41J 2002/16502; B41J 2/162; B41J 2202/03
See application file for complete search history.

(56) References Cited

U.S. PATENT DOCUMENTS

2006/0274113 A1 12/2006 Ono
2011/0074880 A1* 3/2011 Uchiyama ..... B41J 2/14233 347/45
2014/0375725 A1* 12/2014 Sameshima ..... B41J 2/1433 347/45

FOREIGN PATENT DOCUMENTS

DE 199 49 328 A1 5/2001
WO WO 2007/005857 A1 1/2007

* cited by examiner

*Primary Examiner* — Yaovi M Ameh
(74) *Attorney, Agent, or Firm* — Birch, Stewart, Kolasch & Birch, LLP

(57) ABSTRACT

An orifice surface is provided with a coating. A molecule for forming the coating is bonded to the orifice surface through a silicon-carbon bond. The molecule constituting the coating comprises exactly one fluoro-atom. A print head is provided with such orifice surface. In addition, a methods of manufacturing such orifice surface and a method of printing using a print head provided with such orifice surface are disclosed.

10 Claims, 2 Drawing Sheets

ORIFICE SURFACE, PRINT HEAD COMPRISING AN ORIFICE SURFACE AND METHOD FOR FORMING THE ORIFICE SURFACE

CROSS-REFERENCE TO RELATED APPLICATIONS

This application claims priority under 35 U.S.C. § 119(a) to Application No. 15171464.9 filed in Europe on Jun. 10, 2015, the entire contents of which is hereby incorporated by reference into the present application.

BACKGROUND OF THE PRESENT INVENTION

1. Field of the Invention

The present invention relates to an orifice surface provided with a coating. The present invention further relates to a print head comprising such nozzle surface and to a printing apparatus comprising said print head. In addition, the present invention relates to a method for forming an orifice surface.

2. Description of Background Art

In a known print head, the print head comprises a surface having arranged therein at least one nozzle. Ink is ejected from the print head through said nozzle. When printing, ink may be spilled on the nozzle surface of the print head. Ink present on the nozzle surface close to a nozzle may have a negative influence on the performance of a print head during jetting of the ink. Therefore, it is important to prevent presence of contaminants, such as ink, on the nozzle surface close to a nozzle.

It is known to prevent ink to be present close to a nozzle by applying an anti-wetting coating around a nozzle. This prevents the formation of an ink film. Instead, ink that comes into contact with the anti-wetting coating will form a droplet, having a relatively small contact area with the coating.

An example of a specific type of anti-wetting coatings are known e.g. from U.S. Application Publication No. 2011/0074880. In U.S. Application Publication No. 2011/0074880, a nozzle plate provided with a coating is described, wherein the coating is bonded to the nozzle plate through a silicon-carbon bond. This type of coating has high resistance against both alkali and acidic solutions. This is useful, for example when alkali or acidic inks are jetted by the print head provided with the nozzle plate. Further, ink compositions may comprise solid particles, for example polymeric particles and/or pigments. Particles present in the ink may cause fouling of the nozzle surface, for example when ink on the nozzles surface dries. Fouling of the nozzle surface by solid particles on the nozzle surface may negatively influence the jetting of droplets. Therefore, it is preferred that fouling of the nozzle surface is prevented. Fouling of the nozzle surface may be diminished or even prevented by providing the nozzle surface with a suitable anti-fouling coating. However, with respect to the coatings according to U.S. Application Publication No. 2011/0071880, there is room for improvement of the anti-fouling properties.

SUMMARY OF THE PRESENT INVENTION

It is an object of the present invention to provide a nozzle surface provided with a suitable anti-fouling coating for diminishing fouling of the nozzle surface. It is a further object of the present invention to provide a nozzle surface that has both good anti-wetting and good anti-fouling properties.

The above object is achieved in an orifice surface comprising silicon, the orifice surface having arranged therein at least one orifice for ejecting droplets of a fluid, the orifice surface being provided with a coating, wherein a molecule constituting the coating is bonded to the orifice surface through a silicon-carbon bond and wherein the molecule constituting the coating comprises exactly one fluoro atom.

A print head, used in an ink jet printer, comprises an orifice surface, which comprises an orifice. The orifice surface may comprise a plurality of orifices (also referred to as nozzles), for example hundreds or thousands of orifices. The orifices may be arranged in rows. The nozzle surfaces may comprise a plurality of rows of orifices. The orifice surface may be a surface of the print head. Alternatively, the orifice surface may be a surface of an orifice plate that is mounted onto a print head.

Ink is ejected through the orifice onto a receiving member. The orifice surface may comprise silicon. The silicon present in the orifice surface may be used to bond a molecule constituting a coating by forming a silicon-carbon bond, thereby firmly bonding the coating forming molecule and the orifice surface. The molecule constituting the coating, bonded through a silicon-carbon bond provides the orifice surface with a coating. At least one molecule constituting the coating may be bonded to the orifice surface. However, in practice, a large number of molecules constituting the coating may be bonded to the orifice surface. For example, the coating may form a monolayer, wherein all silicon atoms available for bonding are bonded to a molecule constituting the coating through a silicon-carbon bond.

The molecule constituting the coating may comprise exactly one fluoro atom. Surprisingly, it was found that nozzle surfaces provided with a coating, wherein the molecule constituting the coating comprises exactly one fluoro atom shows an improved anti-fouling property. Nozzle surfaces provided with coatings, wherein the molecule constituting the coating is essentially free of fluoro, or wherein the molecule constituting the coatings comprises a plurality of fluoro atoms, show worse anti-fouling property, compared to coatings according to the present invention.

In an embodiment, the molecule constituting the coating has a bonding end and a repellent end. The bonding end of the molecule is the end that may link the molecule to the nozzle surface, thereby bonding the coating to the nozzle surface.

The molecule constituting the coating may further comprise a repellent end. This repellent end may comprise exactly one fluoro atom. The repellent end may provide the nozzle surface with the anti-fouling property. In addition, the repellent end may also provide the orifice surface with an anti-wetting property.

In an embodiment, the bonding end comprises a carbon atom that is bonded to a silicon atom of the orifice surface through the silicon-carbon bond. The carbon atom may form part of the silicon-carbon linkage that bonds the molecule constituting the coating to the orifice surface. The silicon-carbon linkage may provide a coating that is resistant towards both acidic and alkali conditions. Hence, the silicon-carbon bond may provide a robust chemical bond, ensuring that the coating stays on the orifice surface under a wide range of conditions.

In an embodiment, the fluoro atom is positioned at a terminal carbon atom of the molecule, different from the carbon atom at the bonding end. The molecule constituting the coating may comprise a carbon chain. The carbon chain may have two terminal positions. The bonding end may form a first terminal position. The carbon atom at the first terminal position may be bonded to a silicon atom through the silicon-carbon bond. At a second terminal position of the carbon chain, the fluoro atom may be positioned. In this embodiment, the fluoro atom may be positioned away from the bonding end of the molecule. Without wanting to be bound to any theory, it is believed that positioning the fluoro atom at the second terminal position may bring the fluoro atom in closer proximity to possible contaminants that are present, thereby improving the anti-fouling property of the coating.

In a further embodiment, the repellent end is an alkyl group comprising exactly one fluoro atom. The alkyl group may be a linear alkyl group or a branched alkyl group. Preferably, the alkyl group may be a linear alkyl group.

A molecule constituting the coating, wherein the repellent end does not comprise a double or triple carbon-carbon bond may provide improved anti-fouling and anti-wetting properties compared to molecules constituting the coating that do comprise a double and/or triple carbon-carbon double bond.

In an embodiment, the molecule comprises 6-25 carbon atoms. The molecule constituting the coating—including the bonding end and the repellent end—may comprise 6-25 carbon atoms, preferably 8-20 carbon atoms, for example 10-16 carbon atoms. The number of carbon atoms relates to the size of the molecule constituting the coating and hence, may relate to the thickness of the coating provided on the orifice surface. In case the molecule constituting the coating comprises less than 6 carbon atoms, the coating may be too thin to efficiently provide the anti-fouling (and optionally anti-wetting) property to the orifice surface. In case the molecule constituting the coating comprises more than 25 carbon atoms, the ordering of the molecules constituting the coating may be insufficient.

In an aspect of the present invention, a print head is provided, wherein the print head is provided with an orifice surface according to the present invention. In a jetting operation, a print head ejects droplets onto a recording medium in a pre-determined way, thereby forming an image. The droplets that are ejected by the print head may be ejected through at least one orifice. The at least one orifice may be arranged in an orifice surface. By providing a print head with an orifice surface according to the present invention, fouling of the orifice surface may be prevented. Consequently, the jetting stability of a print head may be improved.

In an embodiment, the print head is configured to eject droplets of an ink comprising a water-dispersed resin. Ink compositions comprising a water-dispersed resin are also known as latex inks. Latex inks may be acidic (pH<7) or basic (pH>7). The coating provided on the orifice surface according to the present invention may be resistant to acidic and basic solutions. Therefore, when using a print head provided with an orifice surface according to the present invention, the coating may stay intact when jetting droplets of an ink comprising a water-dispersed resin. Consequently, the orifice surface may keep its anti-fouling property when ejecting droplets of an ink comprising a water-dispersed resin.

In a further aspect of the present invention, a printing apparatus is provided, wherein the printing apparatus is provided with a print head in accordance with the present invention. As mentioned above, jetting stability may improve by providing a print head with an orifice surface according to the present invention. Hence, such print head may be beneficially used in a printing apparatus, for example an inkjet printer.

In a further aspect of the present invention, a method for forming an orifice surface is provided, the method comprising the steps of:

a) providing an orifice surface comprising silicon;
b) providing at least one molecule, the molecule comprising exactly one fluoro atom and a carbon atom for forming a silicon-carbon bond; and
c) bonding the molecule to the orifice surface, thereby forming a silicon-carbon bond.

In step a), an orifice surface comprising silicon is provided. The silicon may be H-terminated or halogen-terminated. Optionally, the surface comprising silicon may be pre-treated such that the surface becomes H-terminated or halogen terminated.

In step b), at least one molecule for constituting the coating is provided. The molecule may be an alkene molecule (comprising a carbon-carbon double bond) or an alkyne molecule (comprising a carbon-carbon triple bond). The double or triple carbon-carbon bond may preferably be positioned at a terminal position of the molecule.

In step c), the molecule is bonded to the orifice surface, thereby forming a chemical silicon-carbon bond. An example of a method for bonding a molecule constituting a coating to an orifice surface comprising silicon, thereby forming a silicon-carbon bond is known e.g. from U.S. Application Publication No. 2011/0074880, paragraphs [0082]-[0111]. U.S. Application Publication No. 2011/0074880 is herein incorporated by reference in its entirety. By bonding the molecule to the orifice surface, the properties of the orifice surface may be modified. For example, the wettability properties and/or anti-fouling properties of the orifice surface may be modified. By using a molecule for constituting the coating that has exactly one fluoro atom, an orifice surface having excellent anti-fouling property may be obtained.

In a further aspect of the present invention, a method for ejecting droplets onto a recording medium is provided, the method comprising the steps of:

a) providing a print head according to the present invention;
b) providing an ink composition comprising a water-dispersed resin; and
c) ejecting droplets of the ink composition onto the recording medium.

In step a), a print head according to the present invention is provided. The print head according to the present invention comprises an orifice surface according to the present invention.

In step b), an ink composition comprising a water-dispersed resin, also known as a latex ink, is provided. The ink composition may be provided in an internal ink reservoir in the print head. Alternatively or additionally, the ink composition may be provided in an external ink reservoir that is in fluid communication with the print head.

In step c), droplets of the ink composition are ejected onto the recording medium. The droplets can be ejected by operating an actuator in the print head. By operating the actuator, the ink composition may be put into motion and a droplet of ink may be ejected via an orifice. By ejecting a predetermined pattern of droplets, an image may be formed on the recording medium.

When ejecting droplets, some ink may be spilled and may contaminate the orifice surface. However, since the print head comprises a nozzle surface according to the present invention, presence of solid contaminants (e.g. particles comprising non-volatile components of the ink composition, such as resins and colorants) may be prevented, due to the anti-fouling property that is provided to the orifice surface by the coating. A coating wherein the molecule constituting the coating comprises exactly one fluoro-atom may efficiently prevent fouling of the orifice surface. Preventing fouling of the nozzle surface may be a beneficial property in case a latex ink is used for printing, since latex inks typically comprises non-volatile components. In the absence of an anti-fouling coating, ink present on the orifice surface may form solid particles upon drying of the ink. Presence of solid particles on the orifice surface may negatively influence the jetting behavior of the print head.

Further, the silicon-carbon bond, via which the molecule for forming the coating is bonded to the orifice surface may be resistant to both acidic and alkali (basic) solutions, such as ink, for example inks comprising a water-dispersed resin. Because the silicon-carbon bond is resistant to both acidic and alkali solutions, the bond may not be cleaved by ink present on the orifice surface. Therefore, the coating may be stable and may stay bonded to the orifice surface for a long period of time. Consequently, the orifice surface may keep its anti-fouling property for a long period of time.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention will now be described with reference to the accompanying drawings.

Figure 1A:
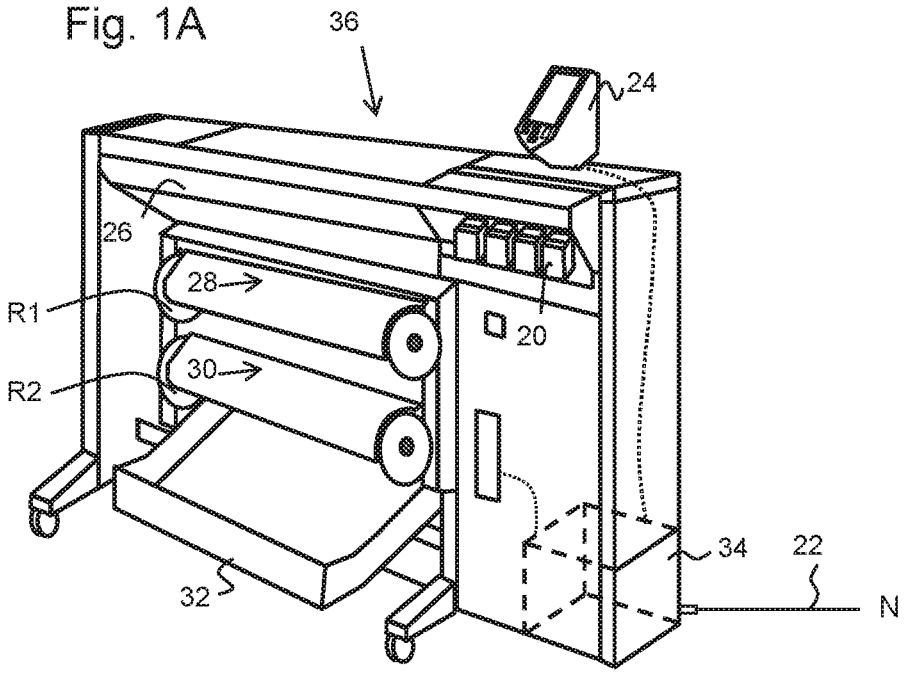
FIG. 1A is a schematic representation of an image forming apparatus.
Figure 1B:
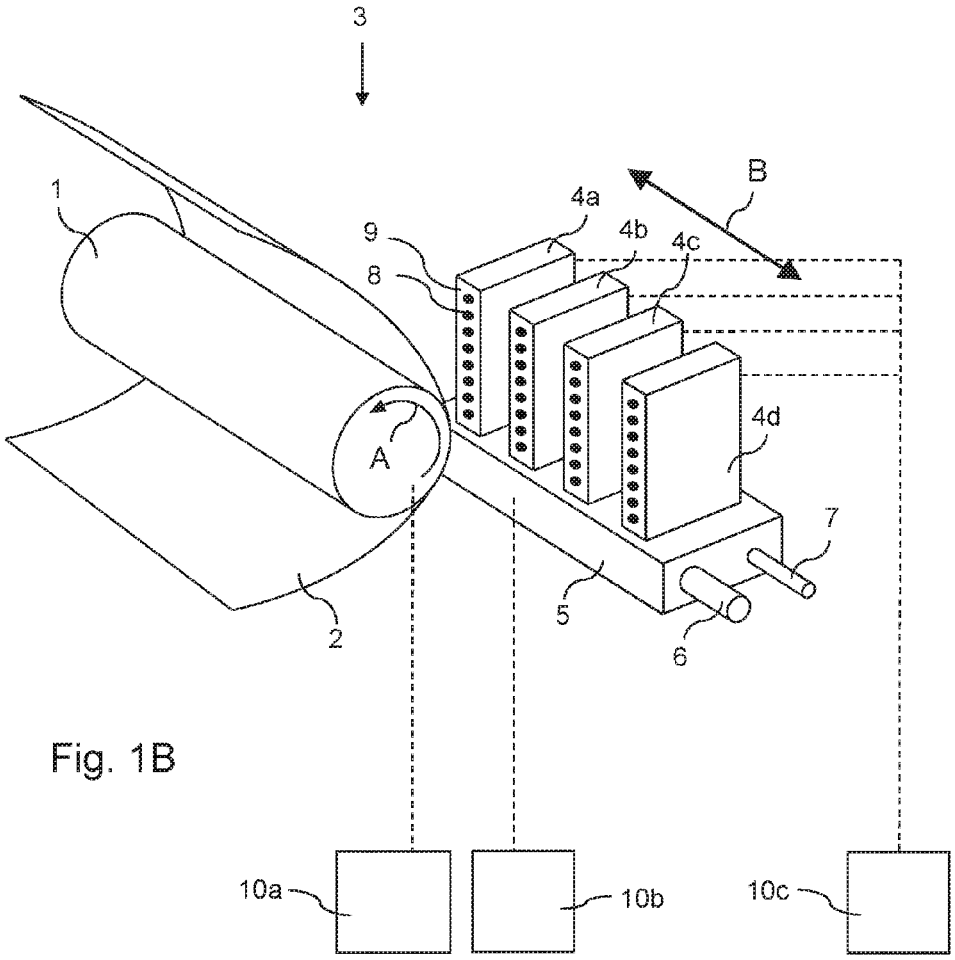
FIG. 1B is a schematic representation of an ink jet printing assembly.

FIG. 1A illustrates an image forming apparatus 36, wherein printing is achieved using a wide format inkjet printer. The wide-format image forming apparatus 36 comprises a housing 26, wherein the printing assembly, for example the ink jet printing assembly shown in FIG. 1B is placed. The image forming apparatus 36 also comprises a storage area configured to store image receiving members 28, 30, a delivery station to collect the image receiving members 28, 30 after printing and a storage area for marking material 20. In FIG. 1A, the delivery station is embodied as a delivery tray 32. Optionally, the delivery station may comprise a processing mechanism configured to process the image receiving members 28, 30 after printing, e.g. a folder or a puncher. The wide-format image forming apparatus 36 further comprises a device that is configured to receiving print jobs and optionally a device that is configured to manipulate print jobs. These devices may include a local user interface unit 24 and/or a control unit 34, for example a computer with a processor.

Images are printed on an image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated with the print engine and may comprise a display unit and a control panel. Alternatively, the control panel may be integrated with the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive print jobs via the network. Further, optionally, the controller of the printer may be provided with a USB port, so print jobs may be sent to the printer via this USB port.

FIG. 1B illustrates an ink jet printing assembly 3. The ink jet printing assembly 3 comprises a support that is configured to support an image receiving member 2. The support is shown in FIG. 1B as a platen 1, but alternatively, the support may be a flat surface. The platen 1, as depicted in FIG. 1B, is a rotatable drum, which is rotatable about its axis as indicated by arrow A. The support may be optionally provided with suction holes for holding the image receiving member in a fixed position with respect to the support. The ink jet printing assembly 3 comprises print heads 4*a*-4*d*, mounted on a scanning print carriage 5. The scanning print carriage 5 is guided by suitable guides 6, 7 to reciprocate in the main scanning direction B. Each print head 4*a*-4*d* comprises an orifice surface 9, which is provided with at least one orifice 8. The print heads 4*a*-4*d* are configured to eject droplets of marking material onto the image receiving member 2. The platen 1, the carriage 5 and the print heads 4*a*-4*d* are controlled by suitable controls 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may be reciprocated in the main scanning direction B parallel to the platen 1, such as to enable scanning of the image receiving member 2 in the main scanning direction B. Only four print heads 4*a*-4*d* are depicted for demonstrating the present invention. However, in practice, an arbitrary number of print heads may be employed. In any case, at least one print head 4a-4d per color of marking material is placed on the scanning print carriage 5. For example, for a black-and-white printer, at least one print head 4a-4d, usually containing black marking material is present. Alternatively, a black-and-white printer may comprise a white marking material, which is to be applied on a black image-receiving member 2. For a full-color printer, containing multiple colors, at least one print head 4a-4d for each of the colors, usually black, cyan, magenta and yellow is present. Often, in a full-color printer, black marking material is used more frequently in comparison to differently colored marking material. Therefore, more print heads 4a-4d containing black marking material may be provided on the scanning print carriage 5 compared to print heads 4a-4d containing marking material in any of the other colors. Alternatively, the print head 4a-4d containing black marking material may be larger than any of the print heads 4a-4d, containing a differently colored marking material.

The carriage 5 is guided by guides 6, 7. The guides 6, 7 may be rods as depicted in FIG. 1B. The rods may be driven by suitable drives (not shown). Alternatively, the carriage 5 may be guided by other guides, such as an arm being able to move the carriage 5. Another alternative is to move the image receiving material 2 in the main scanning direction B.

Each print head 4a-4d comprises an orifice surface 9 having at least one orifice 8, in fluid communication with a pressure chamber containing fluid marking material provided in the print heads 4a-4d. On the orifice surface 9, a number of orifices 8 is arranged in a single linear array parallel to the sub-scanning direction A. Eight orifices 8 per print head 4a-4d are depicted in FIG. 1B, however obviously in a practical embodiment several hundreds of orifices 8 may be provided per print head 4a-4d, optionally arranged in multiple arrays. As depicted in FIG. 1B, the respective print heads 4a-4d are placed parallel to each other such that corresponding orifices 8 of the respective print heads 4a-4d are positioned in-line in the main scanning direction B. This means that a line of image dots in the main scanning direction B may be formed by selectively activating up to four orifices 8, each of them being part of a different print head 4a-4d. This parallel positioning of the print heads 4a-4d with corresponding in-line placement of the orifices 8 is advantageous to increase productivity and/or improve print quality. Alternatively, multiple print heads 4a-4d may be placed on the print carriage adjacent to each other such that the orifices 8 of the respective print heads 4a-4d are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print heads 4a-4d. The ink present on the orifice surface 9 may negatively influence the ejection of droplets and the placement of these droplets on the image receiving member 2. Therefore, it may be advantageous to remove excess ink from the orifice surface 9. The excess of ink may be removed, for example, by wiping with a wiper and/or by application of a suitable anti-wetting property of the surface, e.g. provided by a coating.

EXPERIMENTS AND EXAMPLES

Materials

Three different hexynes (hexadec-1-yne (F0), 16-fluorohexadec-1-yne (F1) and 9,9,10,10,11,11,12,12,13,13,14,14,15,15,16,16,16-heptadecafluoro-hexadec-1-yne (F17)) were synthesized according to the method described in: Pujari, S. P.; Spruijt, E.; Stuart, M. A. C.; Rijn, C. J. M.; Paulusse, J. M. J.; Zuilhof, H. Ultralow Adhesion and Friction of Fluoro-Hydro Alkyne-Derived Self-Assembled Monolayers on H-Terminated Si(111) *Langmuir,* 2012, 28, 17690-17700, and corresponding supporting information.

Silicon wafers, with a 0.2° miscut angle along the (112) plane, were (111)-oriented, n-type, phosphorus-doped and with a specific resistance of 1-10 $\Omega cm^{-1}$, were purchased from Siltronix (France).

Poly (acrylic acid) (PAA, Mn=5000, PDI=1.2), poly(4-chloro styrene) (P4CS, Mn=5000, PDI=1.3), Poly(adipic anhydride) (PAAD, Mn=5000) and Poly(hydroxyl propyl methacrylate) (PHPMA, Mn=5000, PDI=2.20) were provided by Polymer Source. Inc. Polystyrene (PS, Mn=5000, PDI<1.1) and Poly (N-isopropyl acrylamide) (PNIPAM, Mn=5000), were received from Sigma-Aldrich.

All chemicals were used as received unless stated otherwise.

Methods

Fouling Experiment

Clean and well-characterized alkyne modified silicon surfaces were used for the fouling study. The silicon surfaces were submerged in polymer solutions. For all of the experiments, the concentration of the polymer solutions was 10 mg/mL and the experiment was kept for 12 h. All of the surfaces were cleaned and dried with the same procedure (dip the surface into the solvent and shake it for 2 min at 50 rpm, take it out and repeat the above procedure three times and then dried in an 80° C. oven for 2 h). The absorption amount and morphology of polymer on these monolayers were characterized by Ellipsometry. Bare silicon was used as a reference in this polymer absorption survey.

The ellipsometric thickness of the modified surfaces was measured using a rotating Sentech Instruments (Type SE-400) ellipsometer, operating at 632.8 nm (He—Ne laser), and an angle of incidence of 70°. The optical constants of a freshly etched H-terminated Si(111) surface were taken as n=3.850 and k=0.057. The thicknesses of the monolayers were determined with a planar three layer (ambient, monolayer, substrate) isotropic model, with assumed refractive indices of 1.00 and 1.46, 1.44, 1.36 for ambient and the F0, F1 and F17 monolayers, respectively. The reported values are the average of at least 5 measurements and the error is less than 0.1 nm.

Static Contact Angle Measurements

The static contact angle (SCA) measurements were conducted using a Krüss DSA 100 contact angle goniometer having an automated drop dispenser and image/video capture system. The static contact angles were measured at three different places on a modified surface by dispensing three small droplets (3.0 μL volume of deionized water) with the help of an automated drop dispenser. The tangent 1 fitting model was implemented for contact angle measurements with an accuracy of ±2.

EXAMPLES

Production Example (General Description)

A three-necked flask was charged with 2 mL alkyne and purged with argon under reduced pressure for 30 min, while being heated to 80° C. Si(111) wafers were cut into 1×1 $cm^2$ pieces. The surfaces were sonicated for 5 min in pure acetone and subsequently cleaned using air plasma (Harrick Scientific Products, Inc. Pleasantville, N.Y.) for 5 min and quickly transferred to freshly prepared, argon-saturated 40% aqueous ammonium fluoride solution for 15 min. The surfaces were again rinsed with water and dried with a stream of argon. These samples were then immediately transferred into the flask, which was immediately depressurized again. The reaction mixture was kept at 80° C. for 16 h. The sample was then removed from the flask and immediately extensively rinsed with $CH_2Cl_2$, sonicated for 5 min in $CH_2Cl_2$ to remove physisorbed molecules, and blown dry with a stream of dry argon. The surfaces were directly used for surface characterization or stored in the glovebox until fouling experiment.

Production Example 1

F1 (16-fluorohexadec-1-yne) was used as alkyne. Modification of a Si (111) surface using this alkyne resulted in the formation of a modified Si surface (Ex 1).

Comparative Example 1

F0 (hexadec-1-yne) was used as alkyne. Modification of a Si (111) surface using this alkyne resulted in the formation of a modified Si surface (CE 1).

Comparative Example 2

F17 (9,9,10,10,11,11,12,12,13,13,14,14,15,15,16,16,16-heptadecafluoro-hexadec-1-yne) was used as alkyne. Modification of a Si (111) surface using this alkyne resulted in the formation of a modified Si surface (CE 2).

Comparison Experiment 1

The anti-fouling property of the modified Si surfaces was investigated using ellipsometry. Using ellipsometry, the thickness increase of the different monolayers after dipping into polymer solutions was measured. The thickness increase is a measure for fouling. The smaller the thickness-increase of a monolayer is, the better the anti-fouling property of that monolayer. The results are summarized in table 1.

TABLE 1

Thickness increase of different monolayers.

| Polymer solution: | Ex 1 (thickness (nm)) | CE 1 (thickness (nm)) | CE 2 (thickness (nm)) |
|---|---|---|---|
| PAAD | 0.03 | 0.20 | 4.02 |
| PHPMA | 0.04 | 1.00 | 1.50 |
| PNIPAM | 0.01 | 0.36 | 0.52 |
| P4CS | 0.01 | 2.12 | 0.08 |
| PS | 0.03 | 0.52 | 0.07 |
| PAA | 0.02 | 0.12 | 0.02 |

The thickness of the monolayer according to the present invention (Ex 1) hardly increased for any of the polymer solutions tested. Hence, the modified Si surface according to the present invention has an excellent anti-fouling property.

The Si surface modified with the non-fluorinated alkyne (CE 1) showed a thickness increase for 5 of the polymer solutions tested. Hence, CE 1 has a poorer anti-fouling property compared to the surface according to the present invention. The other silicon surface not according to the present invention (CE 2) showed a thickness increase for all polymer solutions tested. Hence, the modified silicon surface according to the present invention has a better anti-fouling property than the modified silicon surfaces not according to the present invention (CE 1 and CE 2).

Comparison Experiment 2

Static contact angle measurements were performed for the three different modified Si surfaces (Ex 1, CE 1 and CE 2). The results are summarized in table 2.

TABLE 2

SCA measurements for different monolayers.

| Sample | Ex 1 | CE 1 | CE 2 |
|---|---|---|---|
| SCA(Water) (°) | 94 ± 2 | 110 ± 1 | 117 ± 2 |

The SCA for Ex 1 is smaller than the SCA for CE 1 and CE 2. Consequently, the modified Si surface according to the present invention (Ex 1) is a little more wettable than the modified Si surfaces not according to the present invention (CE 1, CE 2). However, the value of the SCA for Ex 1 is such that the modified Si surface according to the present invention still provides sufficient anti-wetting property.

CONCLUSION

The modified silicon surface according to the present invention has an improved anti-fouling property compared to the modified silicon surfaces not according to the present invention, while having an acceptable anti-wetting property.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An orifice surface comprising:

silicon;

at least one orifice, said at least one orifice being arranged in the orifice surface for ejecting droplets of a fluid; and a coating, wherein a molecule constituting the coating is bonded to the orifice surface through a silicon-carbon bond, wherein the molecule constituting the coating comprises exactly one fluoro-atom, wherein the molecule constituting the coating has a bonding end and a repellent end, wherein the bonding end comprises a carbon atom that is bonded to a silicon atom of the orifice surface through the silicon-carbon bond, and wherein the fluoro atom is positioned at a terminal carbon atom of the molecule, different from the carbon atom at the bonding end.

2. The orifice surface according to claim 1, wherein the repellent end is an alkyl group comprising exactly one fluoro atom.

3. A print head comprising:

the orifice surface according to claim 1.

4. A method for forming the orifice surface according to claim 1, the method comprising the steps of:

providing an orifice surface comprising silicon;

providing said at least one molecule, the molecule comprising exactly one fluoro atom and a carbon atom for forming a silicon-carbon bond; and bonding the molecule to the orifice surface, wherein the molecule is bonded to the orifice surface through a silicon-carbon bond, wherein the molecule has a bonding end and a repellent end, wherein the bonding end comprises a carbon atom that is bonded to a silicon atom of the orifice surface through the silicon-carbon bond, and wherein the fluoro atom is positioned at a terminal carbon atom of the molecule, different from the carbon atom at the bonding end.

5. The orifice surface according to claim 1, wherein the molecule comprises 8-20 carbon atoms.

6. The orifice surface according to claim 1, wherein the molecule comprises 10-16 carbon atoms.

7. The orifice surface according to claim 1, wherein the molecule comprises 6-25 carbon atoms.

8. The print head according to claim 3, wherein the print head is configured to eject droplets of an ink comprising a water-dispersed resin.

9. A printer comprising:

the print head according to claim 3.

10. A method for ejecting droplets onto a recording medium, the method comprising the steps of:

providing the print head according to claim 3;

providing an ink composition comprising a water-dispersed resin; and ejecting droplets of the ink composition onto the recording medium.

* * * * *